United States Patent [19]

Confer

[11] 4,023,647

[45] May 17, 1977

[54] FREESTANDING LADDER STRUCTURE

[75] Inventor: Raymond C. Confer, Gasport, N.Y.

[73] Assignee: Confer Plastics, Inc., North Tonawanda, N.Y.

[22] Filed: Dec. 18, 1975

[21] Appl. No.: 642,122

[52] U.S. Cl. ..... 182/108; 182/118; 182/46; 182/97; 182/106

[51] Int. Cl.² ..... E06C 9/00

[58] Field of Search ..... 182/118, 119, 107, 108, 182/206, 106, 46, 97; 403/361, 344, 291

[56] References Cited

UNITED STATES PATENTS

| | | | |
|---|---|---|---|
| 2,896,831 | 7/1959 | Ellingson | 182/206 |
| 3,009,532 | 11/1961 | Richard | 182/46 |
| 3,908,795 | 9/1975 | Gannon | 182/118 |
| 3,914,061 | 10/1975 | Meyer | 403/361 |

*Primary Examiner*—Reinaldo P. Machado
*Attorney, Agent, or Firm*—Sommer & Sommer

[57] ABSTRACT

A freestanding ladder structure has a first base member arranged on one side of an object to be bridged, a second base member arranged on the other side of the object, and a raised platform supported above the object by two ladder members having their lower end portions engaged with the base members. The various parts and components of the ladder structure are hollow or tubular and may be conveniently formed of plastic by a well known blow molding technique. Where necessary, a reinforcing insert is arranged within a component to resist flexure or bending thereof. Some components are provided with hook members engagable with other components to prevent unintended separation of the assembled components.

8 Claims, 13 Drawing Figures

Fig. 2.
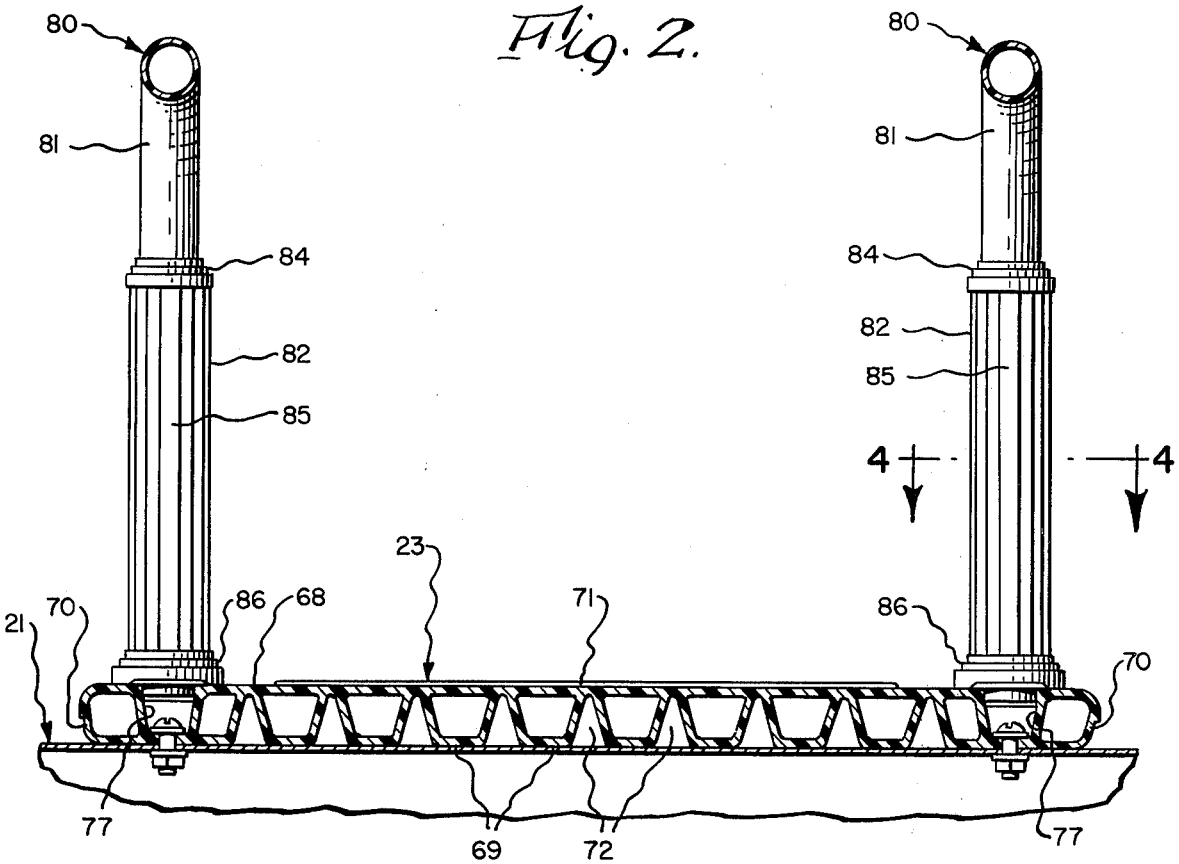
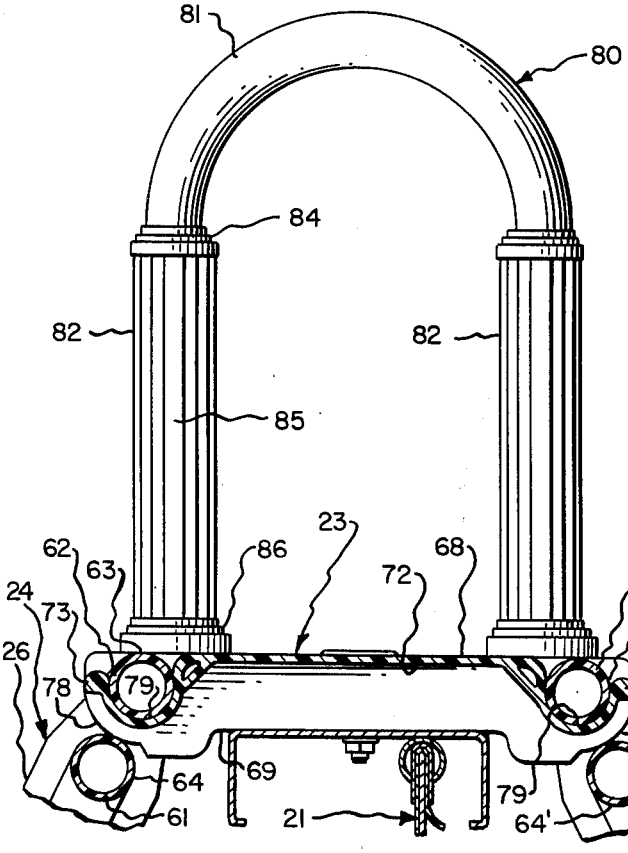
Fig. 3.
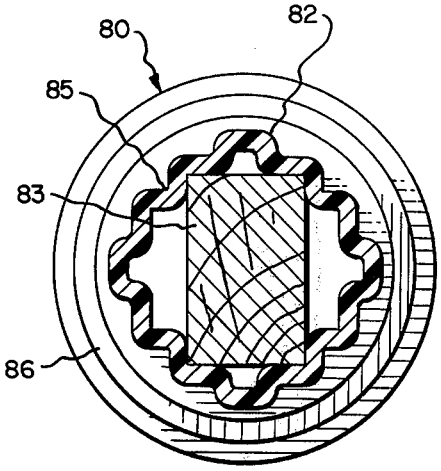
Fig. 4.

80
85
86
83
82
68
75
74
70
69
76

80
85
86
83
68
75
74
70
69
76
88
88

24'
26'
51'
61'
73
23
74
62'
75
71
77
68
70
74
83
62
73
24
51
26
61

60
59
55
53
58
54
54
52
55
56

51
60
59
53
58
55

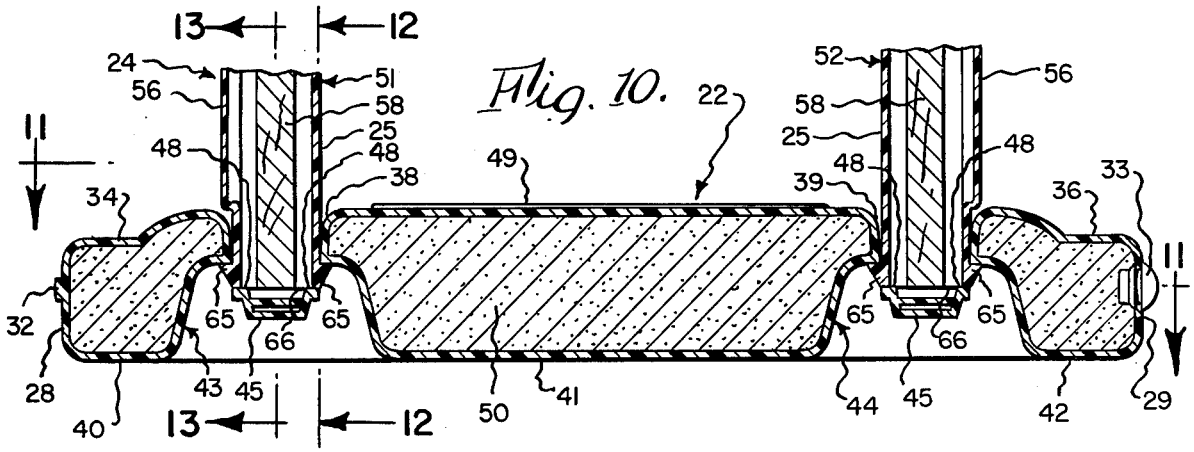
Fig. 10.
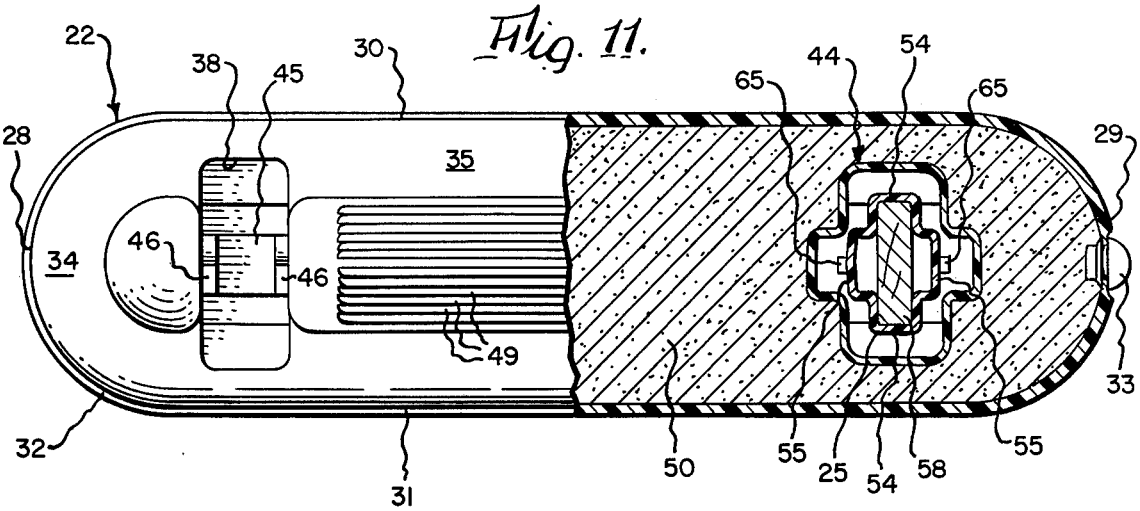
Fig. 11.
Fig. 12.
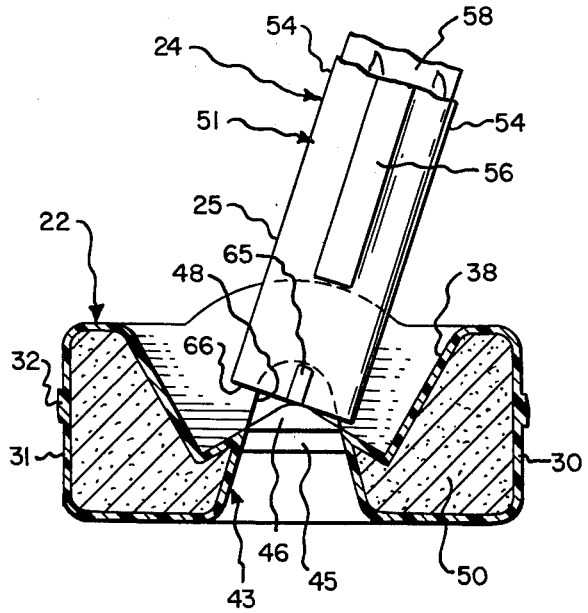
Fig. 13.
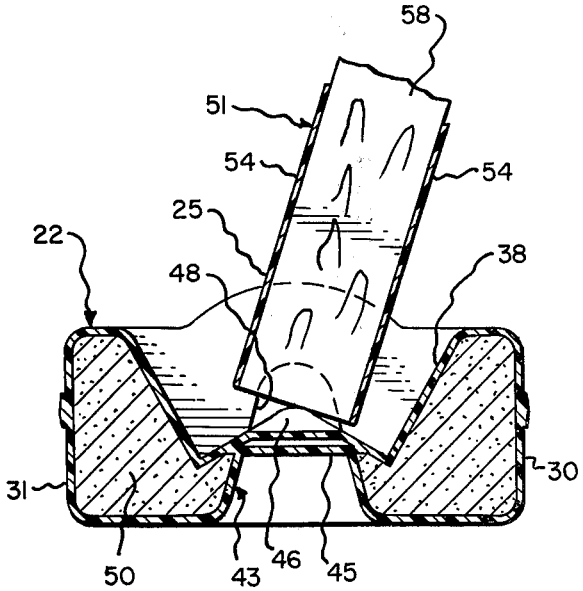

FREESTANDING LADDER STRUCTURE

BACKGROUND OF THE INVENTION

1. Field of the Invention

The present invention relates generally to an improved freestanding ladder structure adapted to bridge an object, and more particularly to an improved freestanding ladder structure which is adapted to bridge the upstanding side wall structure of an aboveground swimming pool or the like.

2. Description of the Prior Art

Earlier forms of freestanding ladder structures are known, as typified by conventional step ladders and fence ladders, both of which are commonly made of wood or aluminum.

However, in some environments, a caustic element may attack the ladder material, one example of such caustic element being chlorine commonly used in swimming pools as a disinfectant and algicide.

One possible solution to this problem is to construct the ladder structure of a material not subject to chemical attack. Plastic affords a range of such material, however, material cost and strength become significant design considerations.

SUMMARY OF THE INVENTION

The present invention overcomes the foregoing deficiency by providing an improved freestanding ladder structure constructed of a suitable plastic material economically formed by a well known conventional blow molding technique, and which is provided with internal reinforcing inserts to resist flexure or bending.

The inventive freestanding ladder structure is adapted to rest on a suitable support to bridge an object, and broadly includes a platform adapted to be positioned above the object; a first ladder member arranged on one side of the object and having a lower end portion arranged to thrustingly engage the support, and having an upper end portion arranged to supportively engage said platform, and a second ladder member arranged on the opposite side of said object and having a lower end portion adapted to thrustingly engage another portion of the support, and having an upper end portion arranged to supportively engage the platform. The side-pieces of the ladder members are hollow tubular members. A reinforcing insert is positioned within these ladder member side-pieces to resist flexure or bending of the ladder members when a person traverses or climbs the ladder structure to bridge the object.

The upper end portion of each of the first and second ladder members may be pivotally connected to the platform such that the lower end portions of these ladder members may be moved toward or away from the object.

The ladder structure may further include at least one handle member mounted on the platform to provide a handle which a person climbing said ladder structure may grasp. Preferably, the platform is provided with a plurality of recesses adapted to receive the end portions of the handle members, and these handle member end portions may be provided with hook members engageable with portions of such recesses to prevent the unintended separation of the handle member from the platform. Moreover, each of the handle members may have at least one hollow tubular portion in which a reinforcing insert may be positioned to resist flexure or bending of the handle member.

The upper end portion of each ladder member may include a pair of longitudinally-spaced cross-pieces, and a hook portion of the platform may be adapted to penetrate the space between these cross-pieces. These hook portions may have a substantially J-shaped transverse cross-section.

The inventive ladder structure may further include a first base member operatively arranged between the first ladder member lower end portion and the support, and a second base member operatively arranged between the second ladder member lower end portion and the support. If desired, the first and second base members may be hollow, and filled with sand. Moreover, each base member may be provided with a recess adapted to receive the lower end portion of its ladder member, and such ladder member lower end portion may be provided with a hook member engageable with such base member recesses to prevent unintended separation of the ladder member from its base member.

Accordingly, one principle object of the present invention is to provide an improved freestanding ladder structure to bridge an object.

Another object is to provide an improved freestanding ladder structure which may be economically manufactured of a plastic material by a well-known blow molding technique.

Another object is to provide an improved freestanding ladder structure made of a hollow or tubular plastic material, and having reinforcing inserts adapted to resist flexure thereof.

Another object is to provide improved means for joining the various parts and components of a freestanding ladder structure.

Still another object is to provide an improved freestanding ladder structure which is particularly adapted to bridge the upstanding side wall structure of an aboveground swimming pool.

These and other objects and advantages will become apparent from the foregoing and ongoing specification, the drawings, and the appended claims.

BRIEF DESCRIPTION OF THE DRAWING FIGURES

FIG. 2 is an enlarged fragmentary vertical sectional view thereof, taken generally on line 2—2 of FIG. 1, and showing the raised platform in longitudinal cross-section, and further illustrating the handle members partly in elevation and partly in cross-section.

FIG. 3 is an enlarged fragmentary vertical sectional view thereof, taken generally on line 3—3 of FIG. 1, illustrating the raised platform in transverse cross-section, showing the left handle member in side elevation, and further illustrating the manner by which the upper portions of the ladder members are connected to the raised platform.

FIG. 4 is a further enlarged fragmentary horizontal sectional view thereof, taken generally on line 4—4 of FIG. 2, showing the shaft of one handle column portion in transverse cross-section, and further illustrating the reinforcing insert arranged therein.

FIG. 10 is an enlarged fragmentary vertical sectional view thereof, taken generally on line 10—10 of FIG. 1, showing one base member in longitudinal cross-section and further showing the manner by which the lower end portion of the ladder member side-pieces are engaged with the base member recesses.

FIG. 11 is a fragmentary top plan view of the base member depicted in FIG. 10, with a portion thereof broken away to illustrate the cross-sectional configuration of the base member recess and the ladder side-piece, this view being taken generally on line 11—11 of FIG. 10.

FIG. 12 is a fragmentary sectional view thereof, taken generally on line 12—12 of FIG. 10, illustrating the base member recess in transverse cross-section, and further showing the lower end portion of a ladder member side-piece in side elevation.

FIG. 13 is a fragmentary vertical sectional view thereof, taken generally on line 13—13 of FIG. 10, this view being generally similar to FIG. 12 but illustrating the base member recess and lower end portion of a ladder side-piece in central transverse cross-section.

DESCRIPTION OF THE PREFERRED EMBODIMENTS

Figure 1:
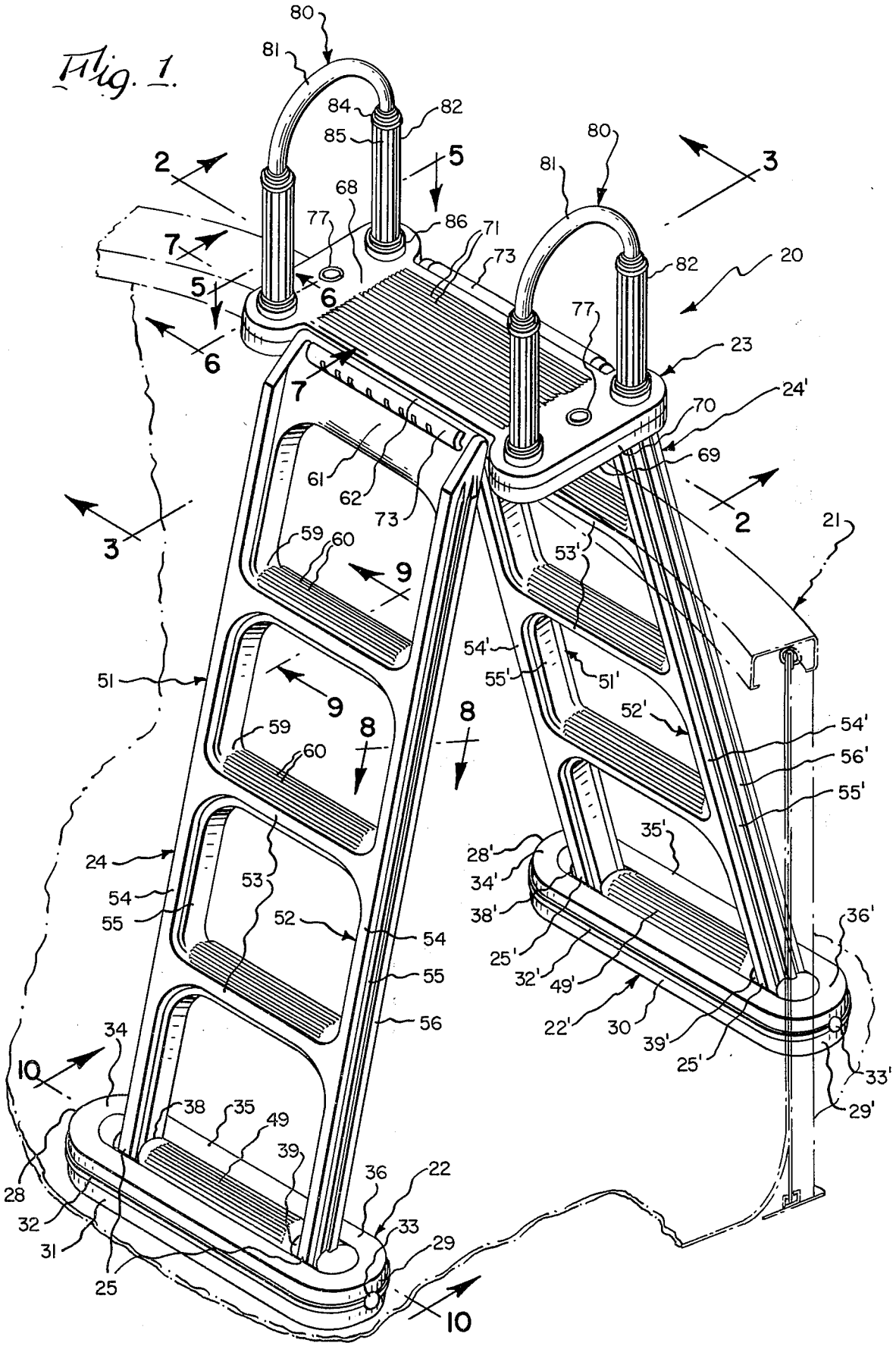
FIG. 1 is a perspective exterior view of the presently preferred embodiment of the inventive ladder structure, this view illustrating the ladder structure as bridging an object (shown in phantom), and further showing the base members, the ladder members, the supported raised platform, and the handle members.

At the outset, it should be clearly understood that like reference numerals are intended to identify the same elements and/or structure consistently throughout the several drawing figures, as such elements and/or structure may be further described or explained by the entire written specification of which this detailed description is an integral part.

Referring now collectively to the various drawing figures and more particularly to FIG. 1 thereof, the present invention provides an improved freestanding reinforced plastic ladder structure, generally indicated at 20, which is particularly adapted to bridge an object 21, one example of which is shown as being the upstanding cylindrical side wall structure of an above-ground swimming pool, such side wall structure being depicted in phantom in FIG. 1. Of course, it will be readily appreciated that the inventive ladder structure herein illustrated and described is not limited to this particular end use, and possesses general utility in other applications apart from this specific swimming pool environment.

Still referring principally to FIG. 1, the presently preferred embodiment of ladder structure 20 is shown as broadly including a first base member 22 adapted to rest directly on the ground or some other suitable support on one side of the object 21 to be bridged; a second base member 22′ also adapted to rest directly on the ground or some other suitable support on the other side of the object to be bridged; a raised platform 23 adapted to be supported directly above the object; a first ladder member 24 having a lower end portion 25 adapted to engage the first base member, and having an upper end portion 26 adapted to supportively engage one portion of the platform; and a second ladder member 24′ having a lower end portion 25′ adapted to engage the second base member, and having an upper end portion 26′ adapted to supportively engage another portion of the platform (FIG. 3). Thus, when viewed from a direction tangential to that portion of the object being bridged, the ladder structure 20 generally appears to have a substantially isosceles trapezoidal outline with the raised platform 23 being substantially parallel to the ground, and with the upwardly and inwardly inclined ladder members 24, 24′, forming the non-parallel legs thereof.

In the preferred embodiment illustrated and described, the first and second base members 22, 22′, and the first and second ladder members 24, 24′, are structurally identical to one another, although they may be differently arranged or positioned. Hence, for the convenience of the reader, only one base member and one ladder member will be explicitly described, it being appreciated that the same reference numeral primed will serve to identify the corresponding element or portion of the other base member or ladder member.

In this preferred embodiment, many of the various parts and components of the ladder structure are shown and described as being hollow or tubular members, and these parts may be easily formed by blow molding a suitable plastic, such as polyethylene.

Referring now collectively to FIGS. 1 and 10–13, the first base member 22 is shown as being a hollow member generally having a downwardly-facing contoured bottom surface, an upwardly-facing contoured top surface, and an intermediate peripherally-extending vertical surface. When viewed in top plan (FIG. 11), this vertical surface may be considered as including a pair of spaced left and right rounded end portions 28, 29, each formed as a segment of a vertical cylinder, separated by an outer portion 30 arranged to face toward the object, and an opposite inner portion 31 arranged to face away from the object. This peripheral vertical surface is shown further provided with a raised bead 32 extending horizontally around the base member at an intermediate portion of its vertical height. A hole may be provided through the right rounded end portion to provide access to the interior of the base member, this hole being selectively closed by a suitable plug 33.

When viewed in central longitudinal vertical cross-section (FIG. 10), the base member top surface appears to have discrete left, intermediate and right planar portions 34, 35 and 36, respectively, separated by a pair of longitudinally-spaced left and right recesses, generally indicated at 38, 39, respectively, which extend downwardly into the base member. As may be best seen in FIG. 11, each of these upper recesses 38, 39 extends longitudinally of the base member for a short distance, and appears to have a substantially W-shaped transverse cross-section (FIG. 13).

The base member bottom surface, when viewed in central longitudinal vertical cross-section (FIG. 10) also appears to have discrete left, intermediate and right planar portions 40, 41, 42, respectively, which are adapted to rest directly on the ground or some other suitable support. In FIG. 10, these bottom planar portions appear to be separated by a pair of left and right recesses, generally indicated at 43, 44, respectively, which extend upwardly into the base member to intersect with recesses 38, 39. As may be seen in FIGS. 10, 12 and 13, each of these lower recesses has a central portion 45 which extends upwardly to meet the upper recess, and two longitudinally-spaced inverted substantially V-shaped end portions 46, 46 which extend upwardly further than the central portion 45.

As may be best seen in FIG. 12, the intersection of each W-shaped upper recess 38, 39 with each inverted V-shaped lower recess 43, 44, respectively, defines a pair of longitudinally-spaced openings 48, 48 at either longitudinal end of the upper recesses, these openings being for a purpose hereinafter explained.

The base member top surface central portion 35 is shown further including a plurality of transversely-spaced longitudinally-extending ribs 49 (FIG. 11), which provide a slip-resistant surface upon which a person may step. Moreover, when used in the swimming pool environment, the base member may be filled with sand 50, or other suitable material, to prevent the ladder structure from floating, and to provide internal rigidity to the base member. It will be remembered that the second base member 22′ is structurally identical to the first base member 22.

Referring now collectively to FIGS. 1, 3, 8 and 10–13, the first ladder member 24 generally appears to have a conventional ladder-like shape including a pair of left and right longitudinally-extending side-pieces 51, 52 separated by a plurality of longitudinally-spaced cross-pieces or rungs 53, three of these being shown in FIG. 1. Preferably, this ladder member 24 is a substantially hollow article formed by a blow molding technique.

Figure 8:
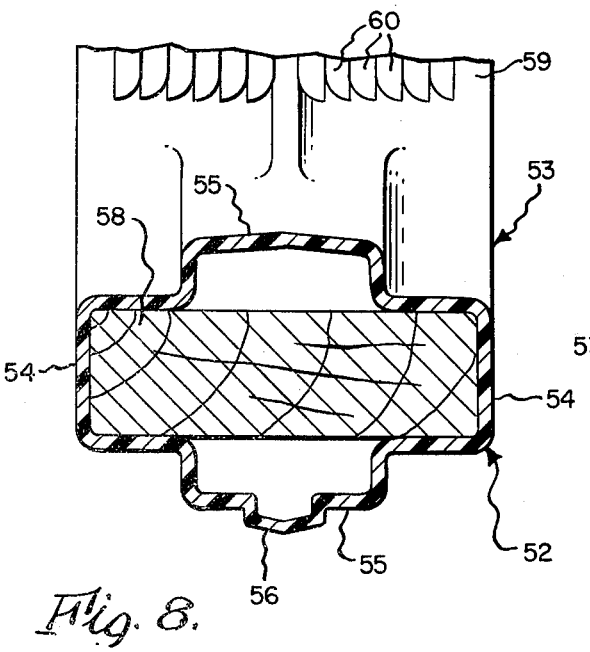
FIG. 8 is an enlarged fragmentary sectional view thereof, taken generally on line 8—8 of FIG. 1, illustrating one ladder member side-piece in transverse cross-section, and further showing the position of a reinforcing insert arranged therein.

As best shown in FIG. 8, the right side-piece 52 is an elongated hollow tubular member having, when viewed in transverse cross-section, a substantially cross-shaped outline or shape formed by two opposed and facing pairs of substantially U-shaped socket portions 54, 54 and 55, 55. Moreover, the right side 55 of this side-piece 52 is shown further provided with an intermediate raised rib 56 also having a substantially U-shaped transverse cross-section. As best shown in FIGS. 8 and 10–13, each of these side-pieces 51 and 52 is adapted to receive therein a reinforcing insert 58, shown here to be a wooden beam having a rectangular transverse cross-section which is adapted to be received between the socket portions 54, 54 (FIG. 8). If the ladder structure is intended for use with a swimming pool, such beam 58 may preferably be cedar. Once inserted into the side-piece, this reinforcing insert 58 functions to strengthen the side-piece and to resist flexure thereof when a user mounts or climbs the ladder.

Figure 9:
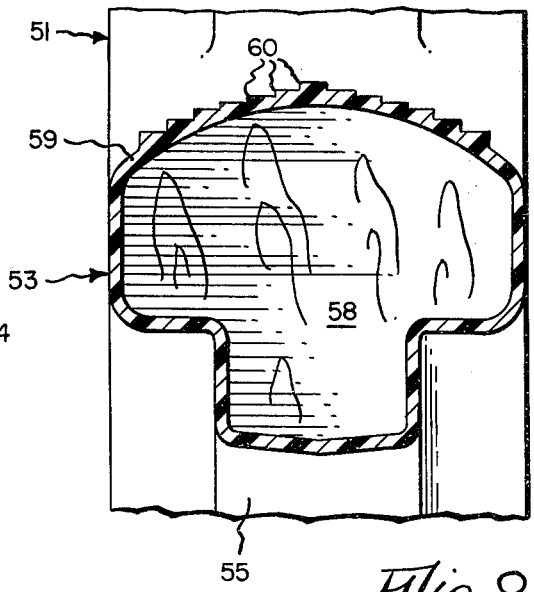
FIG. 9 is an enlarged fragmentary vertical sectional view thereof, taken generally on line 9—9 of FIG. 1, showing a rung of a ladder member in transverse cross-section.

Adverting now to FIGS. 1 and 9, each of rungs 53 is shown as being a horizontally-elongated hollow tubular member having an inflated substantially T-shaped transverse cross-section, and provided with a convex or rounded upper portion 59 having a plurality of stepped ribs 60. As with the ribs 49 of the base members, the ribs 60 on the rungs provide a slip-resistant surface upon which a user may step. In FIG. 1, the left and right end portions of these rungs are shown as being in generally smooth, continuous transition with each of the side-pieces 51, 52.

In FIGS. 1 and 3, the upper portion of each ladder member is shown as including two transversely-extending cross-pieces 61 and 62 which join the spaced side pieces 51, 52. Each cross-piece 61, 62 is a hollow tubular member having a circular transverse cross-section. Thus, the upper cross-piece 62 has a cylindrical outer surface 63, and the lower cross-piece 61 also has a cylindrical outer surface 64.

Returning now to FIGS. 10 and 13, the lower portion 25 of each of side-pieces 51, 52 is provided with an integrally-formed hook member 65 projecting outwardly from each of side-piece lateral surfaces 55, 55 proximate the lowermost open end 66 of the side-piece. The lower ends 66, 66 of side-pieces 51, 52 are adapted to be inserted into the upwardly-facing substantially W-shaped recesses 38, 39 of base member 22 such that these hook members 65, 65 snap into and are received in the transversely-extending openings 48, 48 at either longitudinal end of these recesses (FIG. 12). It will be appreciated that the portions 55, 55 of the side-piece may bend or distort to accommodate such engagement of the ladder member with the base member. Thus, the hook members 65, 65 function to prevent unintended separation of the ladder member 24 from the base member 22.

It will be further appreciated that, although not explicitly shown, the second ladder member 24′ is structurally identical with the first ladder member 24.

Referring now collectively to FIGS. 1–7, the platform 23 is shown as being a generally hollow member having a substantially planar horizontal upper surface 68, a lower surface 69, and an intermediate peripheral substantially vertical surface 70. When viewed in top plan, this platform 23 presents an inflated substantially I-shaped outline.

As with the ladder rungs 53, the upper surface 68 of this platform is also provided with a plurality of transversely-spaced longitudinally-extending ribs 71 which act as a slip-resistant surface upon which a user may stand.

Figure 6:
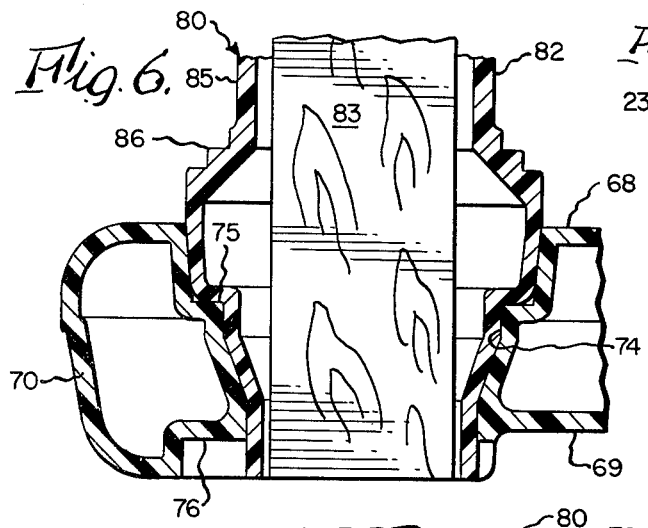
FIG. 6 is an enlarged fragmentary vertical sectional view thereof, taken generally on line 6—6 of FIG. 1, showing a platform handle recess and a handle member base portion in transverse cross-section.
Figure 7:
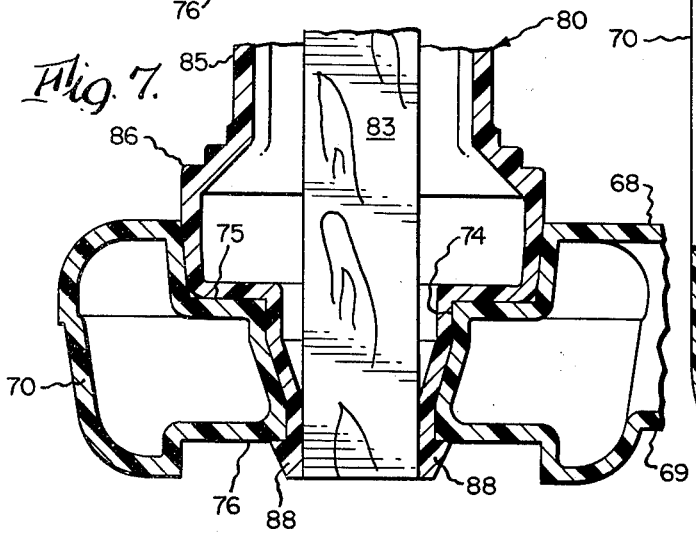
FIG. 7 is an enlarged fragmentary vertical sectional view thereof, taken generally on line 7—7 of FIG. 1, showing a platform handle recess and a handle member base portion in longitudinal cross-section, this view particularly illustrating the handle hook members engaging the downwardly-facing shelf of the platform recess.
Figure 5:
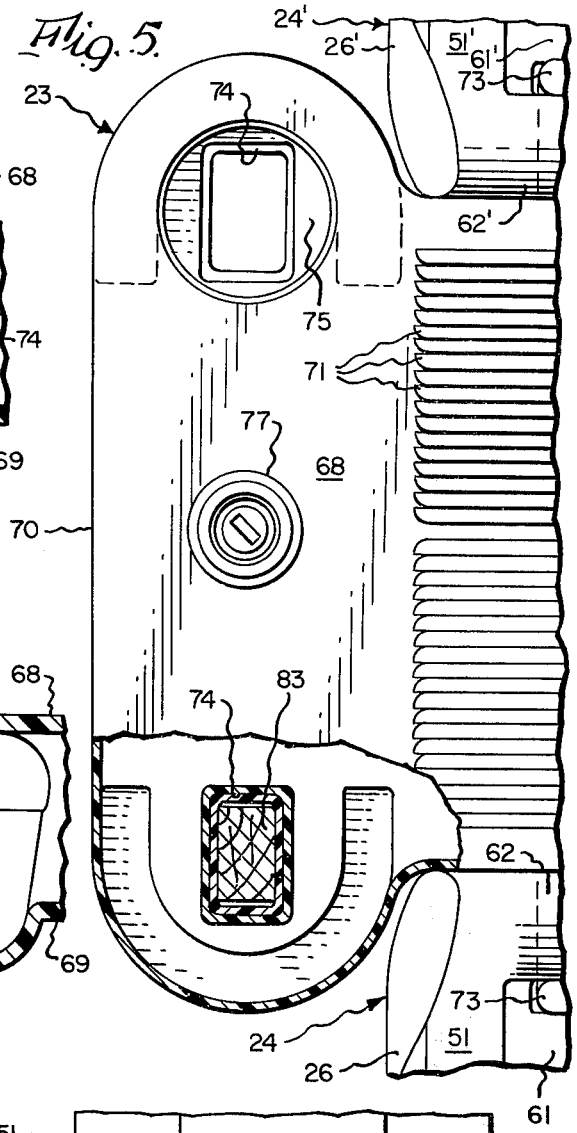
FIG. 5 is an enlarged fragmentary horizontal view, taken generally on line 5—5 of FIG. 1, illustrating one end portion of the platform in top plan, but with a portion thereof broken away to show the internal configuration proximate the handle recess.

The lower surface 69 of the platform is shown as being generally planar, but having a plurality of longitudinally-spaced transversely-extending concave recesses 72 which extend up into the platform. Intermediate its cross-legs, the platform is shown as having a pair of longitudinally-extending arcuate hook portions 73 which appear to have substantially J-shaped transverse cross-sections (FIG. 3). Moreover, the platform is further provided with four rectangular vertical through openings 74, these being symmetrically disposed at the corners of the platform. As best shown in FIGS. 6 and 7, each of these openings 74 has a narrowed intermediate portion configured to provide an upwardly-facing horizontal rectangular shelf 75 recessed from the platform top surface 68, and a downwardly-facing horizontal rectangular shelf 76 recessed from the platform bottom surface 69 for a purpose hereinafter explained. This platform 23 may also have a pair of spaced through holes 77, 77 on its longitudinal axis. As shown, fasteners may penetrate holes 77, 77 to secure this platform to the object being bridged.

As best shown in FIG. 3, each J-hook 73 is adapted to penetrate the space between the ladder member cross-pieces 62, 61, such that its convex lower surface 78 is arranged to contact lower cross-piece cylindrical surface 64, and its concave upper surface 79 is arranged to contact upper cross-piece cylindrical surface 63. It will be appreciated that when the ladder member is in the normally-inclined position shown in FIG. 3, the engagement of the upper cross-piece 62 with J-hook upper surface 79 will prevent the ladder member from moving away from the platform, and the engagement of the lower cross-piece 61 with the J-hook lower surface 78 will prevent the ladder member from moving toward the platform. Otherwise stated, when in the normal position depicted in FIG. 3, the engagement of the J-hooks 73 with the cross-pieces 61, 62 will enable the raised platform to support a load.

Adverting now to FIGS. 1–7, a pair of left and right handle members 80, 80 are shown mounted on the platform 23. Inasmuch as these handle members are structurally identical, only the left handle member 80 will be explicitly described, it being understood that the right handle member has the same elements and function.

As best shown in FIGS. 1–3, the left handle member 80 presents an inverted U-shaped outline, when viewed in side elevation, and includes an uppermost arcuate portion 81 inscribing an arc of 180°, and two columnar portions 82 continuing downwardly and joining the platform 23. In the embodiment illustrated, these handle members may be integrally-formed by a known blow molding technique, and are tubular.

Referring now particularly to FIGS. 3, 4, 6 and 7, each columnar portion 82 is shown being a thin-walled tube having a stepped wall portion which, outwardly, gives the appearance of an architectural column; and, inwardly, defines the corners of a rectangle arranged to confine and hold a reinforcing insert 83 (FIG. 4). When viewed in side elevation (FIG. 3), each column appears to have an upper capital 84, an intermediate shaft 85, and a lower base 86 resting on the platform upper surface 68.

As best shown in FIGS. 6 and 7, a lower portion of the column base 86 is complementarily configured with the platform opening 74 and has a lowermost pair of hook members 88, 88 which may underly and engage the downwardly-facing recessed shelf 76 of the platform to hold the handle member 80 thereto. These handle hook members 88, 88 are structurally and functionally similar to ladder member hook members 65, 65, previously described. When so engaged with the platform 23, these handle members 80, 80 provide handles which may be grasped by a person ascending or descending the inventive ladder structure.

Therefore, it will be seen that the inventive freestanding ladder structure herein illustrated and described minimally includes two base members 22, 22′, two ladder members 24, 24′, and a raised platform 23 supported by the base and ladder members. The platform may be further provided with the optional handle members 80, 80, as desired. One unique feature of the invention is that the various parts of the inventive ladder structure may be economically formed to a hollow or tubular shape by a well known blow molding technique, structural flexure strength being reinforced by the inserts where necessary. Another unique feature is believed to reside in the manner by which the various parts are assembled together to form a stable ladder structure. Still another inventive feature is believed to reside in the specific shapes of the various parts herein disclosed.

While the preferred embodiment of the present invention has been illustrated and described, it will be readily appreciated by persons skilled in this art that various changes and modifications may be made without departing from the spirit of this invention which is generically defined by the following claims.

What is claimed is:

1. A freestanding ladder structure adapted to rest on a support to bridge an object, comprising:
   - a platform adapted to be positioned above said object;
   - a first ladder member arranged on one side of said object and having a lower end portion and having an upper end portion supportively engaging said platform;
   - a second ladder member arranged on the opposite side of said object and having a lower end portion and having an upper end portion supportively engaging said platform, the side-pieces of said first and second ladder members being hollow tubular members;
   - a reinforcing insert positioned within each of said side-pieces to resist flexure thereof;
   - a first base member operatively arranged between said first ladder member lower end portion and said support; and
   - a second base member operatively arranged between said second ladder member lower end portion and support, each of said base members being provided with a recess adapted to receive the lower end portion of the associated ladder member, each of said ladder member lower end portions being provided with at least one hook member engageable with the associated base member recess to prevent unintended separation of each ladder member from its base;
   - whereby a person may traverse said ladder structure to cross said object.

2. A freestanding ladder structure as set forth in claim 1 wherein said upper end portion of each of said first and second ladder members is pivotally connected to said platform such that said lower end portions of said first and second ladder members may be moved toward or away from said object.

3. A freestanding ladder structure as set forth in claim 1, further comprising:
   - at least one handle member mounted on said platform to provide a handle which a person traversing said ladder structure may grasp.

4. A freestanding ladder structure as set forth in claim 3 wherein each of said handle members has a hollow tubular portion in which a reinforcing insert is positioned to resist flexure of said handle member.

5. A freestanding ladder structure as set forth in claim 3 wherein said platform is provided with a recess adapted to receive a portion of said handle member, and said handle member portion is provided with at least one hook member engageable with a portion of said recess to prevent the unintended separation of said handle member from said platform.

6. A freestanding ladder structure as set forth in claim 2 wherein said upper end portion of each of said first and second ladder members has a pair of longitudinally-spaced cross-pieces, and wherein said platform further includes hook portions adapted to penetrate the space between said cross-pieces.

7. A freestanding ladder structure as set forth in claim 6 wherein each of said hook portions has a substantially J-shaped transverse cross-section.

8. A freestanding ladder structure as set forth in claim 1 wherein each of said first and second base members is hollow.

* * * * *